United States Patent [19]

Clement

[11] Patent Number: 4,817,321

[45] Date of Patent: Apr. 4, 1989

[54] MULTIPURPOSE TOOL FOR A MUZZLE LOADING CAP LOCK FIREARM

[75] Inventor: John L. Clement, Benton, Ark.

[73] Assignee: K. W. Thompson Tool Co., Inc., Rochester, N.H.

[21] Appl. No.: 147,820

[22] Filed: Jan. 22, 1980

[51] Int. Cl.[4] ..... F41C 27/00

[52] U.S. Cl. ..... 42/90

[58] Field of Search ..... 42/90, 83

[56] References Cited

U.S. PATENT DOCUMENTS

| | | | |
|---|---|---|---|
| 42,741 | 5/1864 | Bradford | 42/90 |
| 108,359 | 10/1870 | Kahn | 42/90 |
| 4,112,606 | 9/1978 | Griffin | 42/90 |
| 4,135,322 | 1/1979 | Tice et al. | 42/90 |
| 4,205,475 | 6/1980 | Wilson | 42/90 |
| 4,334,376 | 6/1982 | Winslow | 42/90 |
| 4,419,839 | 12/1983 | Wilson | 42/90 |
| 4,571,873 | 2/1986 | Houk | 42/90 |
| 4,589,220 | 5/1986 | Lofland | 42/90 |

*Primary Examiner*—Charles T. Jordan

*Attorney, Agent, or Firm*—Blodgett & Blodgett

[57] ABSTRACT

A multipurpose tool for a cap lock muzzle loading firearm. The combination tool includes a number of disengageable tools which are used in the charging and priming of a firearm, and following discharge, removal of spent or unfired caps and removal with cleaning and/or replacement of the nipple if conditions merit. The combination of the tool components may be varied for servicing a particulate part of the firearm.

21 Claims, 1 Drawing Sheet

FIG. 1
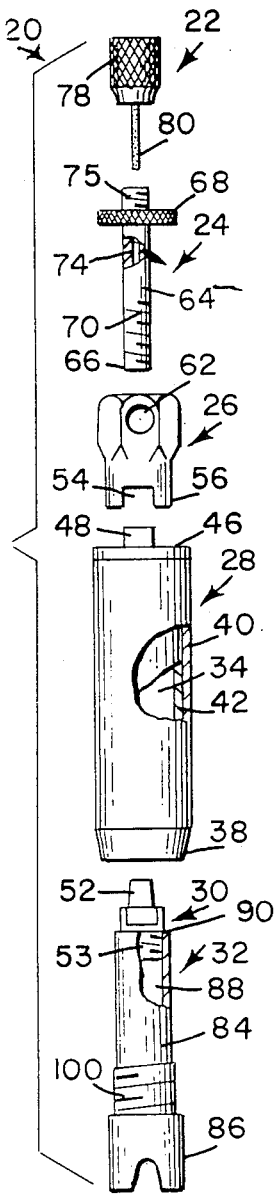
FIG. 2
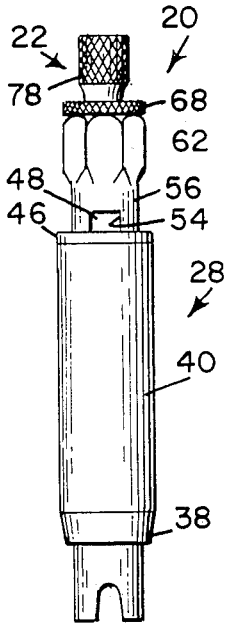
FIG. 3
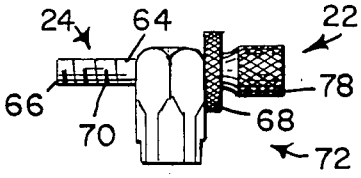
FIG. 4
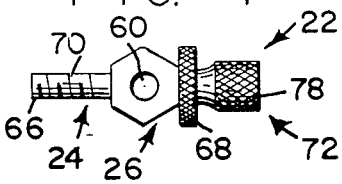
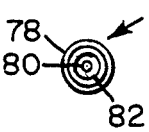
FIG. 7
FIG. 5
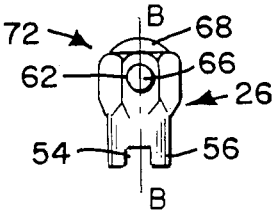
FIG. 6
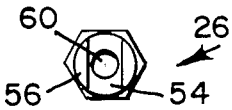
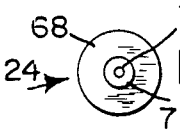
FIG. 8
FIG. 10
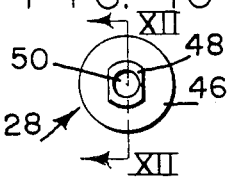
FIG. 13
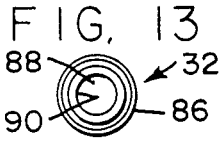
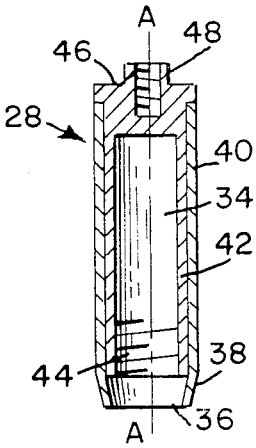
FIG. 12
FIG. 14
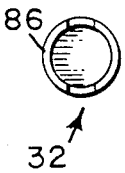
FIG. 11
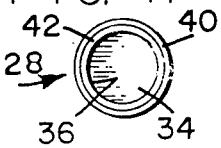
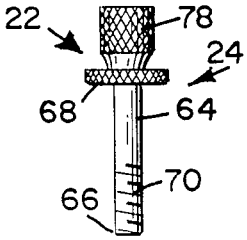
FIG. 9

MULTIPURPOSE TOOL FOR A MUZZLE LOADING CAP LOCK FIREARM

BACKGROUND OF THE INVENTION

1. Field of the Invention:

The present invention relates to a multipurpose tool for a muzzle loading cap lock firearm and, more particularly, to a tool which is used in the charging, and priming of a firearm, and following discharge, removal of spent or unfired caps and removal with cleaning and/or replacement of the nipple if conditions merit.

2. Setting for the Invention:

The overall functioning and safety features of a cap lock firearm are different from modern rifles and pistols. The operation of the firearm begins with an understanding of the firearm's workings and of the tools and materials necessary to affect proper use of a muzzle loader. Professional instruction in the use and handling of muzzle loading guns is strongly recommended.

The charging of a cap lock muzzle loader must only be done with black powder or with other propellants specifically designed for use in muzzle loading cap lock firearms. These propellants, when properly loaded, generate a relatively low breech pressure upon the discharge of the firearm. The load of a propellant charge is based on the manufacturers'0 specification for the particular firearm and secondarily on the best performing load for the shooter, but within the load limits set by the manufacturer. Consequently, a consistent load of propellant is desired for optimal use of the firearm. The uniform charging of the load is achieved by use of a propellant measuring body which includes graduated markings. This tool should be used whenever the firearm is charged, regardless of the expertise that the shooter has acquired in charging the firearm, as a safe gun handling procedure.

Priming of the cap lock firearm should only be done prior to discharge. The availability of a dry percussion cap, which must be properly fit onto the nipple, is necessary for successful ignition of the charge. Field conditions, however, may cause the shooter's caps to be inoperational. It is desirable, therefore, to have a reserve of caps, unaffected by moisture and extreme heat. This reserve of caps is best stored in an airtight container.

Another propellant ignition problem associated with the muzzle loader is where the nipple port is obstructed by powder fouling or other materials. This problem is usually corrected by passing a serrated rod through the nipple's port. The rod may also be used for general cleaning of the nipple port after extended use of the firearm. Successive discharges of the firearm within a short period of time will, on occasion, damage a nipple; whereby, for example, a percussion cap can no longer be properly fit onto the nipple. It is therefore advantageous to have a spare nipple available to replace the damaged nipple, or where effective cleaning of an obstructed nipple port cannot be be accomplished in the field.

Removal of a nipple for replacement or cleaning can only be performed with the use of a compatible nipple wrench. The nipple of a conventional firearm is threadidly engaged into the barrel; and a requisite amount of force must be applied through the nipple wrench to unthread the nipple. A nipple wrench and a spare nipple should always be carried by the shooter, when in the field. The shooter may optionally elect to remove the nipple as a safety precaution when the firearm is not in use.

Following discharge of the firearm, the spent cap is removed from the nipple by means of a decapper. The decapper should effectively clear the nipple's exterior of the spent cap, so that the subsequent priming of the firearm can be done properly. The ready accessibility of the decapper to the shooter is a requisite for the continous use of the firearm.

The effective operation of a cap lock muzzle loading firearm, therefore, requires the availability of a number of tools, materials and spare parts in order that the situations described above can be redressed. The small size of these components and the frequency or the infrequency of their use has created a need for an effective assembly of the components for the cap lock muzzle loader shooter.

OBJECTIVE OF THE INVENTION

Accordingly, it is a primary object of the present invention to provide a multipurpose tool for use in the operation of a muzzle loading cap lock firearm.

It is another object of the invention to provide a multipurpose tool, for use in the operation of a muzzle loading cap lock firearm which, when assembled, prevents the loss of its component parts.

A further object of the invention is to provide a combination propellant measuring body and nipple wrench with handle for use in the operation of a muzzle loading cap lock firearm.

It is another object of the invention to provide a combination nipple wrench with handle and a cleaning rod assembly for use in the operation of a muzzle loading cap lock firearm.

A still further object of the invention is to provide a combination cap holder body and a spare nipple for use in the operation of a muzzle loading cap lock firearm.

Still another object of the invention is to provide a combination decapper and a cap holder body with cover for use in the operation of a muzzle loading cap lock firearm.

Another object of the invention is to provide a combination propellant measuring body, nipple wrench with handle, cleaning rod assembly, decapper, cap holder body and spare nipple carrier for use in the operation of a muzzle loading cap lock firearm.

With these and other objects in view, as will be apparent to those skilled in the art, the invention resides in the combination of parts set forth in the specification and covered by the claims appended hereto.

SUMMARY OF THE INVENTION

In general, the invention consists of a multipurpose tool for use in the operation of a muzzle loading cap lock firearm.

The operation of a muzzle loading cap lock firearm requires that the shooter have available a number of tools and materials in readying the firearm for discharge. Particular care must be taken in the charging, priming and cleaning of the firearm; and from this respect, the advantages of the multipurpose combination tool of the present invention are apparent.

The invention consists of various combinations of tools which are used in the operation of muzzle loading cap lock firearms. The combinations are designed for servicing selected parts of the firearm, for example, the nipple, with the nipple wrench with handle and cleaning rod assembly combination, or for preparing the firearm for discharge, by priming, with the decapper and cap holder body combination. One preferred combination provides the full compliment of tools which would enable the shooter to service and replace the nipple and to perform the priming and charging operations before discharge of the firearm.

BRIEF DESCRIPTION OF THE DRAWINGS

FIG. 1 is a side elevational view of the components of the multipurpose tool of the present invention oriented in non-assembled alignment, FIG. 2 is a side elevational view of the multipurpose tool shown in an assembled configuration, FIG. 3 is a side elevational view of the two-part nipple wrench and cleaning rod assembly combination and showing the two-part nipple wrench in operational engagement, FIG. 4 is a top view of the two-part nipple wrench and cleaning rod assembly combination, FIG. 5 is an end view of the two-part nipple wrench and cleaning rod assembly combination, looking into the direction of arrow V of FIG. 4.

FIG. 6 is a bottom plan view of the nipple wrench,

FIG. 7 is a bottom plan view of the cleaning rod assembly,

FIG. 8 is a top plan view of the handle position of the nipple wrench,

FIG. 9 is a side elevational view of the handle and cleaning rod assembly,

FIG. 10 is a top plan view of the propellant measuring body,

FIG. 11 is a bottom plan view of the propellant measuring body,

FIG. 12 is a sectional of the propellant measuring body, taken along the line XII—XII of FIG. 9 and looking in the direction of the arrows, FIG. 13 is a top plan view of the decapper, and FIG. 14 is a bottom plan view of the decapper.

DESCRIPTION OF THE PREFERRED EMBODIMENT

Referring to FIGS. 1 and 2, the multipurpose tool of the present invention is generally indicated by reference numeral 20. The tool 20 comprises a combination of parts for use in the operation of a muzzle loading cap lock firearm (not shown). The component parts of the tool 20, as shown in FIG. 1, include a cleaning rod assembly 22, a handle 24 and nipple wrench 26, a propellant measuring body 28, a spare nipple 30 and a decapper 32. The description of the parts of the tool 20 and of the operational combinations of the above-noted parts are described below.

Referring also to FIGS. 11 and 12, the propellant measuring body 28, includes a cavity 34 for holding a quantity of propellant and an opening 36 to the cavity 34 at one end 38 of the body. The end 38 of the body 28 is preferably tapered to enable the end 38 to be inserted into the barrel muzzle (not shown) on charging the firearm with the load of measured propellant from the cavity 34. The body 28 is also preferably expandable telescopically to enable the cavity to accommodate selectively greater loads of propellant. The body 28 comprises an outer tube 40 and an inner tube 42 which is slidably mounted within the outer tube 40. Graduated markings (not shown) on the outer surface of the tube 42 allow the shooter to repetitively charge the firearm with a uniform load for each setting of the tubes. The markings and telescopic expansion further enable the propellant measuring body to be used for charging rifles and pistols of various caliber.

The propellant measuring body 28 further includes connecting means for engaging a part or a combination of parts to be described which are useful in the operation of the firearm. Notably, the opening 36 of the body includes a threaded bore 44 within the inner tube 42, as shown in FIG. 12. In addition, the opposite end 46 of the body 28 includes a projection 48 having a threaded bore 50, see FIGS. 10 and 12. The bores 44 and 50 each lie along the central longitudinal axis A—A of the body 28.

Referring to FIGS. 1 and 3-6, the nipple wrench 26 includes a socket 54 at one end 56 of the wrench for engaging a complimentary shaped portion 52 of the nipple 30. The nipple 30 has a threaded end 53 which enables the nipple to be threaded into the barrel of a firearm. The socket 54 has an axis of rotation B—B. Rotation of the socket 54 about the axis B—B causes the wrench 26 to be rotated for unthreading the nipple from the barrel of the firearm and for threading the nipple into the barrel. The projection 48 of the body 28 is complimentary in shape to the socket 54, so that the wrench 26 may be removably seated on the body 28.

The wrench 26 also includes a bore 60 which extends entirely through the wrench. The bore 60 extends along the axis of rotation B—B of the socket 54 and opens into the socket 54, see FIGS. 4 and 6. A hole 62 extends transversely to the axis of rotation B—B and entirely through the wrench 26, see FIG. 1.

The handle 24 includes a shank 64 having a free end 66 which is extendable completely through the bore 60 of the wrench 26. The extension of the free end 66 beyond the bore 60 is limited by a stop 68 which is located on the handle 24. The free end 66 includes external threads 70 for screwing the free end 66 into the threaded opening 50 of the body 28 for attaching the combination handle 24 and wrench 26 to the body.

Referring particularly to FIGS. 1, 8 and 9, the handle 24 further includes a cavity 74 and a threaded end 75 for receiving the cleaning rod assembly 22. The end 75 has an opening 77 to the cavity 74 adjacent the stop 68. The stop 68 in the preferred embodiment is a knurled nut; which is actuated by hand for threading the free end 66 of the handle 24.

Referring to FIGS. 1 and 7, the cleaning rod assembly 22 includes a head portion 78 and a serrated cleaning rod 80 which is fixed to and projects from the head portion. The cleaning rod of the preferred embodiment is comprised of a ferrous metal or alloy having a gauge smaller than the diameter of the nipple port (not shown) of the firearm's nipple. The abrasiveness of the cleaning rod will remove debris adhering to the walls of the nipple port on reaming the cleaning rod through the nipple port. The head portion 78 includes a threaded bore 82 through which the cleaning rod 80 centrally projects. The cleaning rod assembly 22 is attached to the lever 24 by extending the rod 80 through the opening 77 into the cavity 74 and threading the end 75 into the opening 82.

The handle 24, the cleaning rod assembly 22 and the wrench 26 are combined by extending the free end 66 of the handle through the hole 62 of the wrench to form an operational nipple wrench, generally indicated by the reference numeral 72, as shown in FIGS. 3-5. The extension of the free end 66 beyond the hole 62 allows the threaded end 66 to be screwed into the threaded bore 50 of the body 28 to form an enlarged T-wrench (not shown). The enlarged T-wrench enables the shooter to apply additional torque, if needed, in threading and unthreading the nipple from the firearm.

Referring to FIGS. 1 and 14, the decapper 32 includes a long body 84 having a head 86 which is designed to remove spent caps from the nipple of the firearm. The decapper may also be used to remove a non-spent cap in the case of a misfire. The decapper 32 includes a cavity 88 for holding a number of caps and an opening 90 to the cavity at the end of the decapper which is opposite the head 86. The opening 90 is provided with internal threads for securing a threaded cover. The cover protects the caps within the cavity 88 from exposure to extreme temperature changes and/or dampness. In the preferred embodiment, the spare nipple 30 functions as the cover for the opening 90. The nipple 30 has external threads for engaging the internal threads of the opening 90 and for threadingly securing the nipple to the barrel of the firearm.

The decapper 32 further includes external threads 100 on the body 84 adjacent the head 86 for engaging the internal threads of the bore 44. This enables the decapper 32 to be attached to the propellant measuring body 28 so that the body 84 extends into the cavity of the inner tube 42 as shown in FIG. 2.

Having now described the parts of the tool 20 their assembly into the preferred embodiment will now be described. The shank 64 of the handle is extended through the bore 60 of the wrench 26 and is threaded into the bore 50 within the projection 48 of the body 28, so that the socket 54 engages the projection 48 and is prevented from rotating along the axis of rotation A—A. The axis of rotation B—B of the wrench 26 is aligned with the central longitudinal axis A—A of the propellant measuring body 28 upon their connection. The cleaning rod assembly 22 is attached to the handle 24, with the cleaning rod 80 extending into cavity 74 at the threaded end 75 of the handle. The spare nipple 30 is secured to the opening 90 of the cavity 88 of the decapper 32. The long body 88 of the decapper is extended into the cavity 34 through the opening 36 of the cavity of the propellant measuring body 28. The threads 100 of the decapper are threaded into the bore 44 of the propellant measuring body to seal the opening 36 to the cavity 34. The assembled unit of the preferred embodiment is shown in FIG. 2. It is noted that the order of assembly just described may be modified relative to the use of a particular part of the tool by the shooter. The tool (20) provides the user with the necessary parts in the practice and operation of a muzzle loading cap lock firearm.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A multipurpose tool for a muzzle loading cap lock firearm comprising:

(a) a propellant measuring body having a cavity for holding a quantity of propellant and an opening to the cavity at the end of said body, (b) a nipple wrench having a socket at one end for engaging a complementary shaped portion of a nipple which is threaded into the barrel of a cap lock firearm, said socket having an axis of rotation wherein rotation of said socket about said axis causes rotation of said nipple for unthreading the nipple from the firearm's barrel and threading the nipple into the firearm's barrel, said wrench having a bore which extends entirely through the wrench, (c) a handle which is removably attached to said wrench for rotating said wrench about said axis, said handle having a shank which has a free end which is extendable through said bore so that a portion of said free end extends beyond said bore, said handle having a stop which limits the extension of said free end beyond said bore and, (d) connecting means for removably attaching said shank to said propellant measuring body when said shank is located in said bore and extends beyond said bore, whereby said propellant measuring body, said wrench and said handle are combined for convenience purposes.

2. A multipurpose tool as recited in claim 1, wherein said connecting means comprises:

(a) a threaded bore in said propellant measuring body, and (b) external threads on the free end of said shank for threadingly engaging said threaded bore.

3. A multipurpose tool as recited in claim 2, wherein the bore in said wrench extends along the axis of rotation of said socket and opens into said socket, and, wherein said propellant measuring body has a projection which is complementary in shape to said socket, and said threaded bore is located in said projection so that when said shank extends through the bore of said wrench and is threaded into said threaded bore, the socket engages said complementary spaced projection and said wrench is prevented from rotating about said axis, and said wrench is trapped along said axis between said body and said stop.

4. A multipurpose tool as recited in claim 3, wherein said propellant measuring body is elongated, said body having said opening which is located at one end of said body and said projection being located at the opposite end of said body, said body having a central longitudinal axis which extends through the projection, so that the longitudinal axis of said wrench is aligned with the central longitudinal axis of said body when said wrench is connected to said body.

5. A multipurpose tool as recited in claim 3, wherein said wrench includes a hole which is transverse to the longitudinal axis of said wrench, said hole being adapted to receive the shank of said handle for rotating said wrench about its axis of rotation.

6. A multipurpose tool as recited in claim 5, wherein said hole extends entirely through said wrench, so that the threaded end of said handle extends beyond the wrench when the shank portion is inserted through said hole, thereby enabling said threaded end to be threaded into the said threaded end of the propellant body, so that said body forms with said handle a T wrench.

7. A multipurpose tool as recited in claim 2, wherein said stop comprises a knurled nut, which is actuated by hand, for threading the threaded bore of said propellant measuring body.

8. A multipurpose tool as recited in claim 1, wherein said handle further includes a cavity and wherein said multipurpose tool further comprises:

(a) a cleaning rod assembly having a head portion and an elongated serrated cleaning rod which is fixed to and projects from said head portion, and (b) mounting means for removably attaching said cleaning rod assembly to said handle, so that said cleaning rod extends into the cavity of said handle.

9. A multipurpose tool as recited in claim 1, wherein said multipurpose tool further comprises:

(a) a decapper for removing caps from the nipple of a caplock firearm, and (b) connecting means for removably mounting said decapper to said propellant measuring body.

10. A multipurpose tool as recited in claim 9, wherein said decapper comprises:

(a) a long body having a chamber or storing a number of priming caps for a cap lock firearm and an opening to the chamber, and a head for removing caps, which is located at the opposite end of said opening, and (b) a removable cover for said opening of the chamber.

11. A multipurpose tool as recited in claim 10, wherein said cover is a nipple for a cap lock firearm.

12. A multipurpose tool as recited in claim 11, wherein said long body extends into the cavity of said propellant measuring body through the opening to said cavity when said decapper is connected to said propellant measuring body, so that the opening to the cavity of said propellant measuring body is sealed.

13. A multipurpose tool as recited in claim 10, wherein said long body extends into the cavity of said propellant measuring body through the opening of said cavity when said decapper is connected to said propellant measuring body.

14. A nipple tool for a muzzle loading cap lock firearm comprising:

(a) a nipple wrench having a socket at one end for engaging a complimentary shaped portion of a nipple which is threaded into the barrel of the firearm, said socket having an axis of rotation wherein the rotation of said socket about said axis causes rotation of said nipple for unthreading the nipple from the barrel and threading the nipple into the barrel, said nipple wrench having a bore which extends entirely through the nipple wrench, (b) a handle which is removably appended to said nipple wrench for rotating said nipple wrench about said axis, said handle having a shank which has a free end which is extendable through said bore of the nipple wrench, so that a portion of said free end extends beyond said bore, said handle having a stop which limits the extension of said free end beyond said bore, said handle having a cavity and an opening to the cavity, (c) a cleaning rod assembly having a head portion and a serrated cleaning rod which is fixed to and projects from said head portion, and (d) connecting means for removably attaching said cleaning rod assembly to said handle, whereby said nipple wrench, said handle and said cleaning rod assembly are combined for convenience purposes.

15. A nipple tool as recited in claim 14, wherein the opening of said cavity is located at said free end, and wherein said connecting means comprises:

(a) a threaded bore in said head portion of the cleaning rod assembly, said cleaning rod projecting centrally from said bore, (b) external threads on the free end of said shank for threadingly engaging said threaded bore so that said cleaning rod extends into the cavity of said handle through the opening to said cavity when said cleaning rod assembly is connected to said handle.

16. A priming assembly for a muzzle loading cap lock firearm comprising:

(a) a cap holder body having a cavity for holding priming caps for a cap lock firearm and a threaded opening to the cavity at one end of said body, and (b) a spare nipple for a cap lock firearm which has external threads for threadingly securing said nipple to the barrel of the firearm and for engaging the threaded opening of the cavity to function as a cover.

17. A priming assembly as recited in claim 16, wherein said cap holder further comprises a decapper at the opposite end of said threaded opening.

18. A multipurpose tool for a muzzle loading cap lock firearm comprising:

(a) a decapper having a decapping element for removing caps from the nipple of a cap lock firearm, said decapper having an elongated body which includes a chamber for storing a number of priming caps for a cap lock firearm and an opening to the chamber, and (b) a removable cover for said opening of the chamber.

19. A multipurpose tool as recited in claim 18, wherein said cover is a spare nipple for a cap lock firearm.

20. A multipurpose tool for a muzzle loading cap lock firearm comprising:

(a) a propellant measuring body having a cavity for holding a quantity of propellant and an opening to the cavity, (b) a nipple wrench having a socket at one end for engaging and rotating a complimentary shaped portion of a nipple which is threaded into the barrel of a cap lock firearm, said nipple wrench being removably secured to said propellant measuring body, (c) a multipurpose handle which selectively functions as a handle for rotating said nipple wrench and as means for securing said nipple wrench to said propellant measuring body, (d) a cleaning rod assembly having a head portion and a serrated cleaning rod which projects from said head portion, said head portion being removably attached to said handle, (e) a decapper for removing caps from the nipple of a cap lock firearm, said decapper having an elongated body which includes a chamber for storing a number of priming caps and an opening to the chamber, said decapper being removably connected to said propellant measuring body, and (f) a removable cover for the opening of said decapper.

21. A multipurpose tool as recited in claim 20, wherein said cover is a spare nipple for a cap lock firearm.

* * * * *

UNITED STATES PATENT AND TRADEMARK OFFICE

CERTIFICATE OF CORRECTION

PATENT NO. : 4,817,321

DATED : April 4, 1989

INVENTOR(S) : John L. Clement

It is certified that error appears in the above-identified patent and that said Letters Patent is hereby corrected as shown below:

Title page:

item [22], Filed: "Jan. 22, 1980" should read --Jan. 22, 1988--.

Signed and Sealed this

Third Day of October, 1989

*Attest:*

DONALD J. QUIGG

*Attesting Officer*

*Commissioner of Patents and Trademarks*